US007815058B2

(12) United States Patent
Cheng

(10) Patent No.: US 7,815,058 B2
(45) Date of Patent: Oct. 19, 2010

(54) PORTABLE TOOL RACK

(76) Inventor: Chin-Shun Cheng, No. 37, Ching-Dau 1st Street, Taichung (TW) 404

( * ) Notice: Subject to any disclaimer, the term of this patent is extended or adjusted under 35 U.S.C. 154(b) by 59 days.

(21) Appl. No.: 12/212,650

(22) Filed: Sep. 18, 2008

(65) Prior Publication Data

US 2010/0065522 A1 Mar. 18, 2010

(51) Int. Cl.
*A47F 7/00* (2006.01)

(52) U.S. Cl. ..... 211/70.6; 211/60.1; 206/349; 206/372; 206/376

(58) Field of Classification Search ..... 211/70.6, 211/69, 87.01, 85.8, 60.1, 70.8, 4; 206/376, 206/372, 373, 377, 378; 248/316.7
See application file for complete search history.

(56) References Cited

U.S. PATENT DOCUMENTS 2,068,308 A * 1/1937 Zerver ..... 206/376
5,020,666 A * 6/1991 Barlean ..... 206/376
5,730,303 A * 3/1998 Chow ..... 211/70.6
6,401,923 B1 * 6/2002 Huang ..... 206/376
6,536,611 B2 * 3/2003 Chen ..... 211/70.6
6,758,350 B2 * 7/2004 Lin ..... 211/70.6
6,832,684 B2 * 12/2004 Huang ..... 206/376
6,837,382 B2 * 1/2005 Chen ..... 211/70.6
7,055,689 B2 * 6/2006 Chen ..... 206/376
7,584,845 B2 * 9/2009 Cheng ..... 206/376
7,624,863 B2 * 12/2009 Meng ..... 206/349

FOREIGN PATENT DOCUMENTS

EP 440909 A1 * 8/1991

* cited by examiner

*Primary Examiner*—Darnell M Jayne
*Assistant Examiner*—Patrick Hawn

(57) ABSTRACT

A tool rack includes a frame having two sidewalls and two slots are defined through the two sidewalls. A plurality of first recesses are defined in the frame and a rod having second recesses is connected between the two sidewalls. A restriction member is connected to the frame and two distal ends of the restriction member are movably engaged with the slots of the frame. The restriction member includes third recesses which are located in alignment with the first recesses so that the tools are engaged with the first, second and third recesses. A stop plate extends from a distal end of an inside of each third recess so as to prevent the tools from disengaging from these recesses. When shifting the restriction member, the stop plates are moved away from the first recesses so that the tools can be picked out from the tool rack.

10 Claims, 19 Drawing Sheets

A-A

B-B

A-A

B-B

A-A

B-B

PORTABLE TOOL RACK

FIELD OF THE INVENTION

The present invention relates to a portable tool rack with restriction member to positioning the tools in the rack and the tools are arranged to save space of the rack.

BACKGROUND OF THE INVENTION

A conventional tool rack is disclosed in U.S. patent application Ser. No. 11/616,856 and includes a frame with a slide groove and multiple recesses which are located on two sides of the slide groove so as to receive the tools. The recesses each are composed of two clamp plates and each clamp plate has a spring piece which biases the tool to position the tool within the recesses. A restriction member is slidably connected to the frame and includes multiple restriction portions which are snapped on the tools to preventing the tools from disengaging from the recesses. At least one locking member connects the restriction member to the frame.

However, the clamp plates protrude from the frame and easily tangle the user's sleeves or clothes. The multiple clamp plates are arranged on the whole frame and make the frame look awkward. The tools are received in the frame at an angle and this occupies a lot of space so that the frame becomes bulky. The function ends of the tools protrude out from the frame and may be hit by stiff parts during working and this may damage the function ends. The tool rack can only accommodate fixed sizes of tools and which is not convenient for the users.

The present invention intends to provide a portable tool rack for carrying tools such as wrenches which are well positioned and can be arranged to save space required.

SUMMARY OF THE INVENTION

The present invention relates to a tool rack and comprises a frame having two slots defined through two sidewalls thereof and a plurality of first recesses are defined in the frame and a protrusion extends from one of two insides of each first recess. A guide rail is located between the two sidewalls and located close to the two slots of the first connection portion. A rod is connected between the two sidewalls and includes second recesses which are located alignment with the first recesses. A restriction member has two distal ends movably engaged with the slots of the frame. A plurality of third recesses are defined in the restriction member and located in alignment with the first recesses. A stop plate extends from a distal end of an inside of each third recess. The stop plate is removably located corresponding to the first recesses. The restriction member has a guide surface which is slidably engaged with the guide rail so that the restriction member is moved to shift the stop plates relative to the first recesses. A locking pin connects the restriction member to the frame.

The primary object of the present invention is to provide a tool rack that arranges the tools to be received within a minimum space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
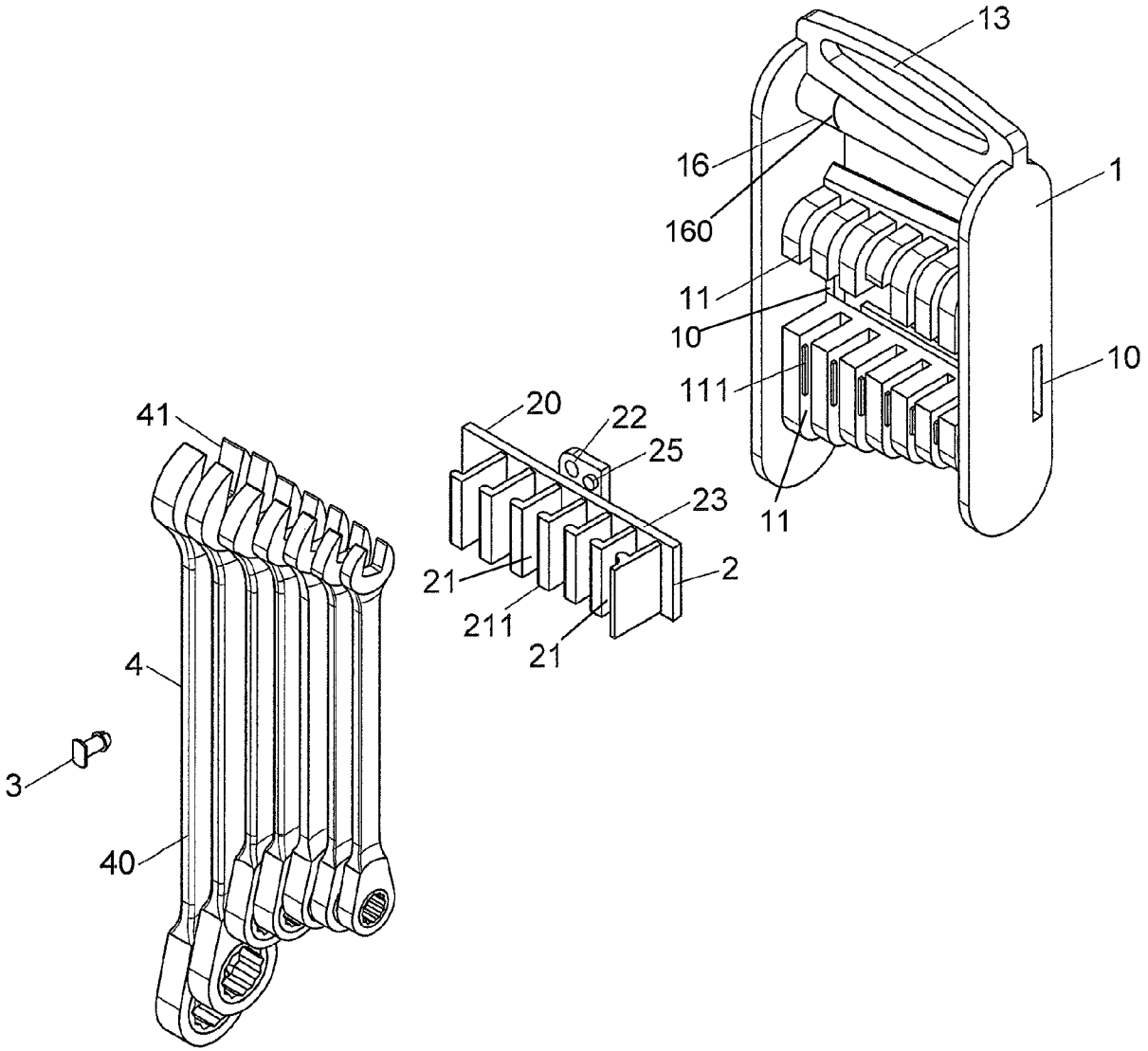
FIG. 1 is an exploded view to show the tool rack of the present invention.
Figure 2:
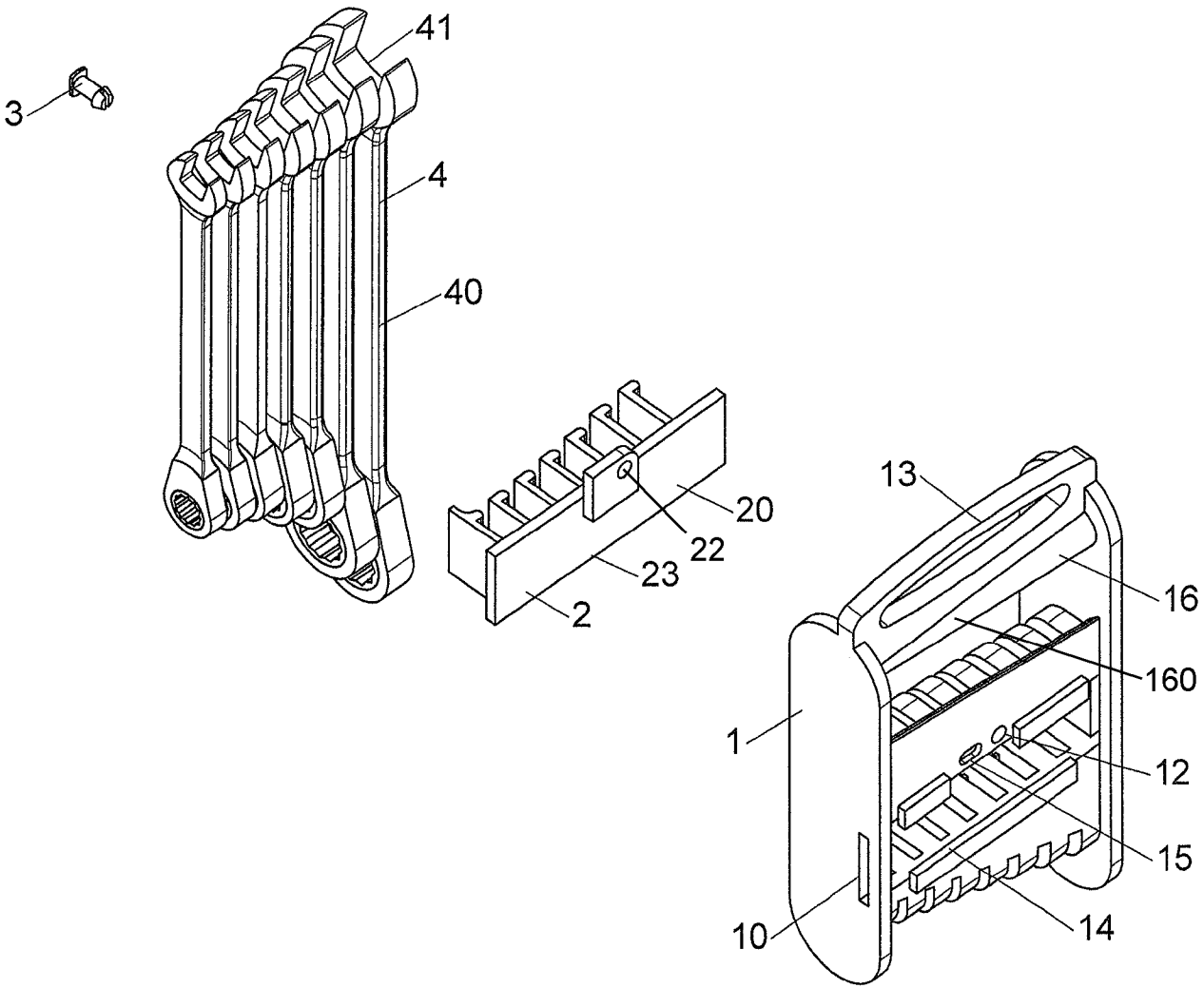
FIG. 2 is an exploded view to show the tool rack of the present invention from another angle of view.

Referring to FIGS. 1 to 4, the tool rack of the present invention comprises a frame 1 having a first connection portion 10 which includes two slots defined through two sidewalls of the frame 1 and a handle with a handle hole 13 is connected between the two sidewalls. A plurality of first recesses 11 are defined in the frame 1 each for engaging a shank 40 of a tool 4, and the first recesses 11 are separated into two groups with a distance between the two groups of the first recesses 11. Two protrusions 111 extend from two insides of each first recess 11 so as to form a narrow opening for holding the shank 40 of the tool 4. The two slots are located between the two groups of the first recesses 11. A guide rail 14 is located between the two sidewalls and located close to the two slots of the first connection portion 10. A rod 16 is connected between the two sidewalls and includes second recesses 160 which are located alignment with the first recesses 11.

A restriction member 2 has an elongate board and a plurality of extensions extend from one side of the elongate board so as to define a plurality of third recesses 21 between the extensions. The restriction member 2 has a second connection portion 20 which includes two distal ends of the elongate board and the two distal ends are movably engaged with the slots of the first connection portion 10. The third recesses 21 are located in alignment with the first recesses 11. A stop plate 211 extends from a distal end of an inside of each of the extensions defining the third recess 21. The stop plates 211 are removably located corresponding to the first recesses 11 and respectively located within the width of distal ends of the first recesses 11. The restriction member 2 has a guide surface 23 which is slidably engaged with the guide rail 14 so that the restriction member 2 is moved a distance to shift the stop plates 211 relative to the first recesses 11. The two groups of the first recesses 11 are located on two sides of the restriction member 2.

The frame 1 includes a snap hole 12 and the restriction member 2 has a through hole 22 which are located in alignment with the snap hole 12. A locking pin 3 extends through the through hole 22 and snaps with the snap hole 12 to connect the restriction member 2 to the frame 1. The locking pin 3 can be removed before using the tool rack. An elongate hole 15 is defined in the frame 1 and located close to the snap hole 12, the restriction member 2 has a positioning member 25 which is movably engaged with the elongate hole 15.

The tools 4, such as the wrenches, each include a function end 41 and a shank 40, the shank 40 is engaged with the first and third recesses 11, 21, and the function end 41 is engaged with the second recesses 160.

Figure 6:
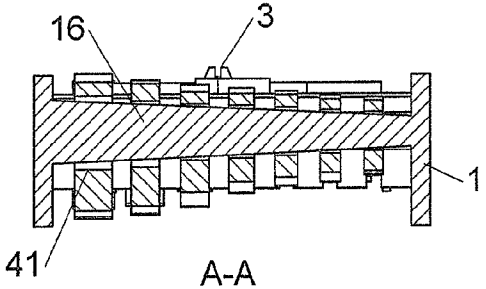
FIG. 6 is a cross sectional view, taken along line A-A in FIG. 5.
Figure 7:
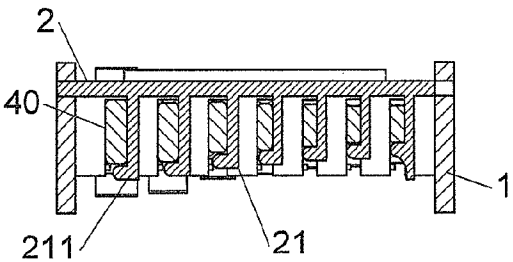
FIG. 7 is a cross sectional view, taken along line B-B in FIG. 5.
Figure 5:
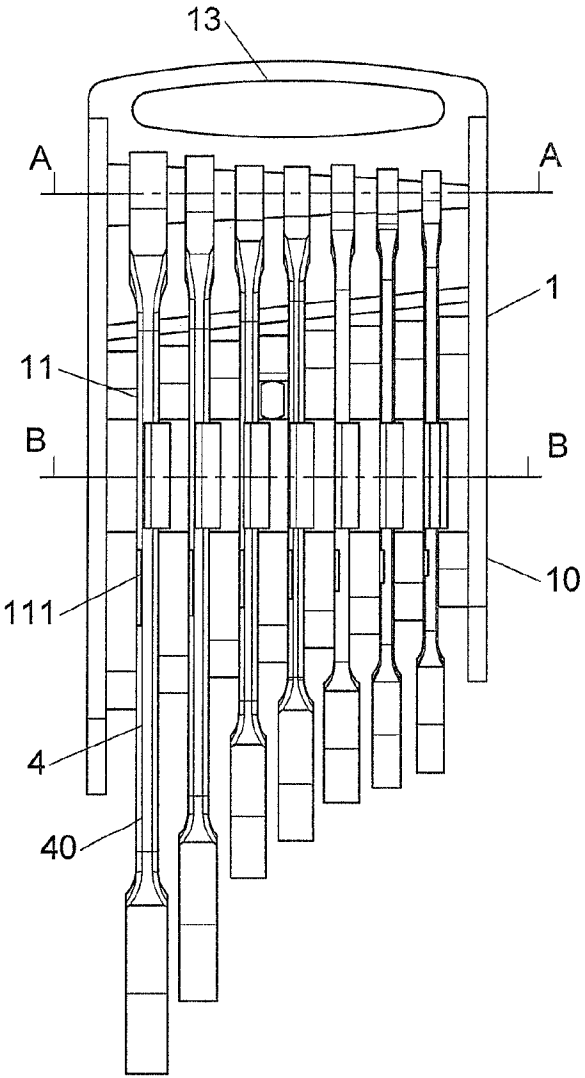
FIG. 5 is a front plane view of the tool rack of the present invention, wherein the restriction member is not yet shifted.
Figure 9:
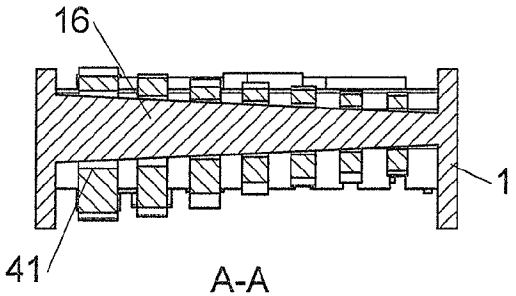
FIG. 9 is a cross sectional view, taken along line A-A in FIG. 8.
Figure 10:
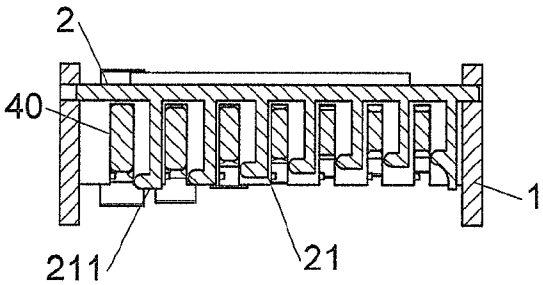
FIG. 10 is a cross sectional view, taken along line B-B in FIG. 8.
Figure 8:
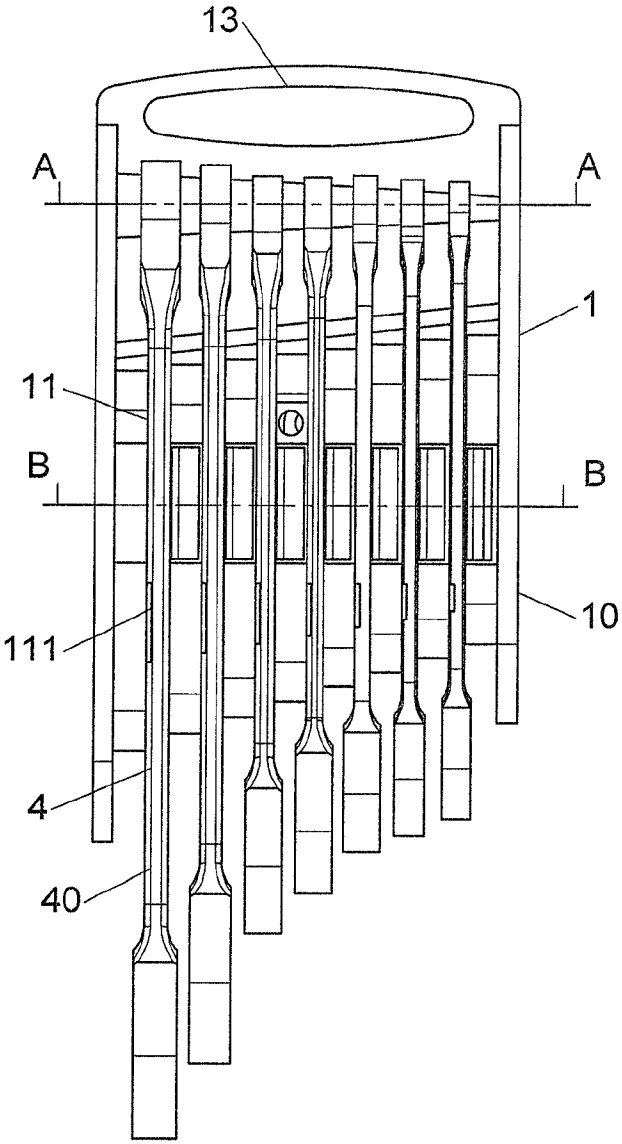
FIG. 8 is a front plane view of the tool rack of the present invention, wherein the restriction member is shifted.

As shown in FIGS. 5 to 7, when the restriction member 2 is not yet shifted, the shanks 40 of the tools 4 cannot be removed from the first recesses 11 because of the stop plates 211. As shown in FIGS. 8-10, when shifting the restriction member 2, the two distal ends of the elongate board of the restriction member 2 are moved a distance within the slots of the first connection portion 10, so that the stop plates 211 are moved away from the first recesses 11 and the tools 4 can be removed from the tool rack.

Figure 11:
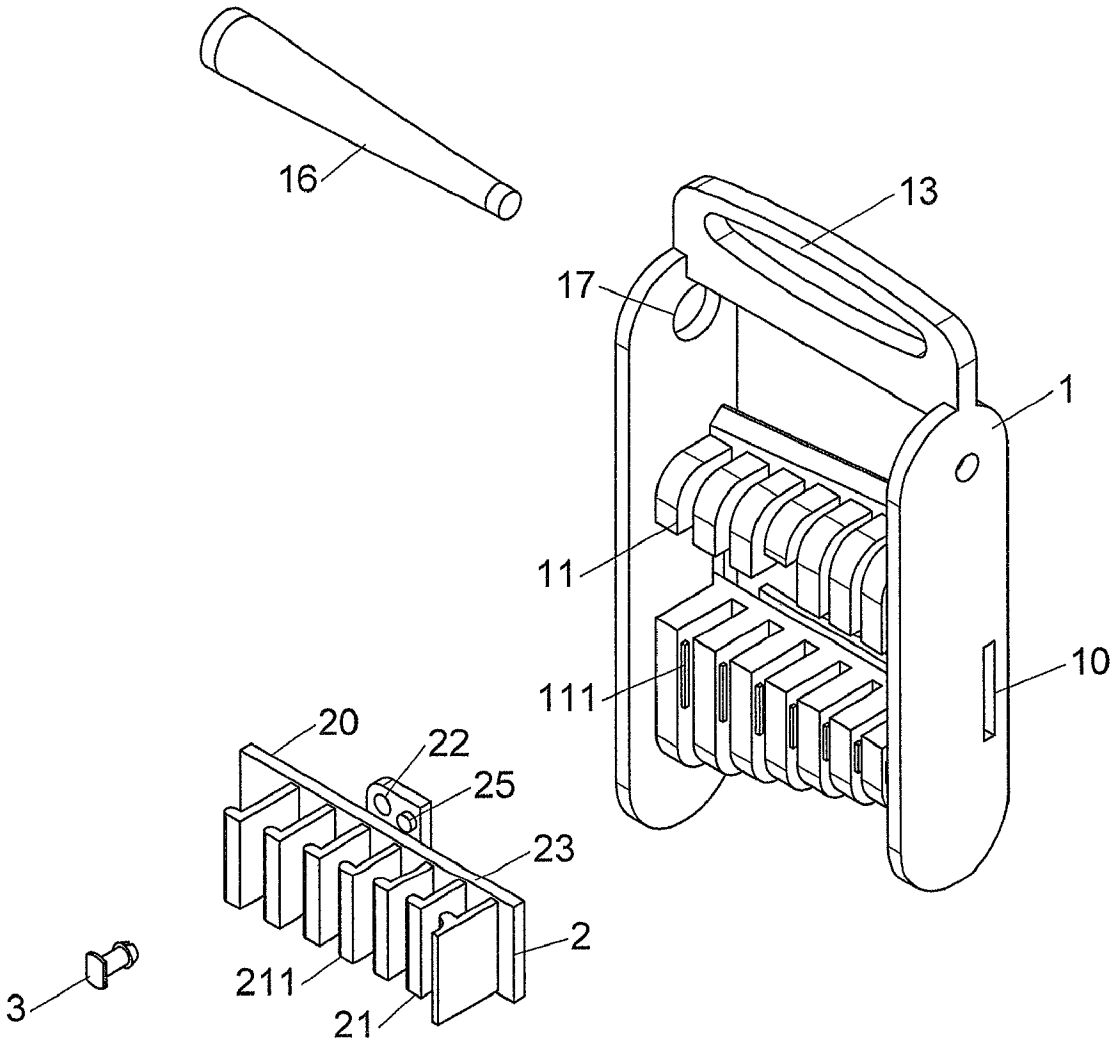
FIG. 11 shows that the rod and the frame of the tool rack are two separated parts.
Figure 12:
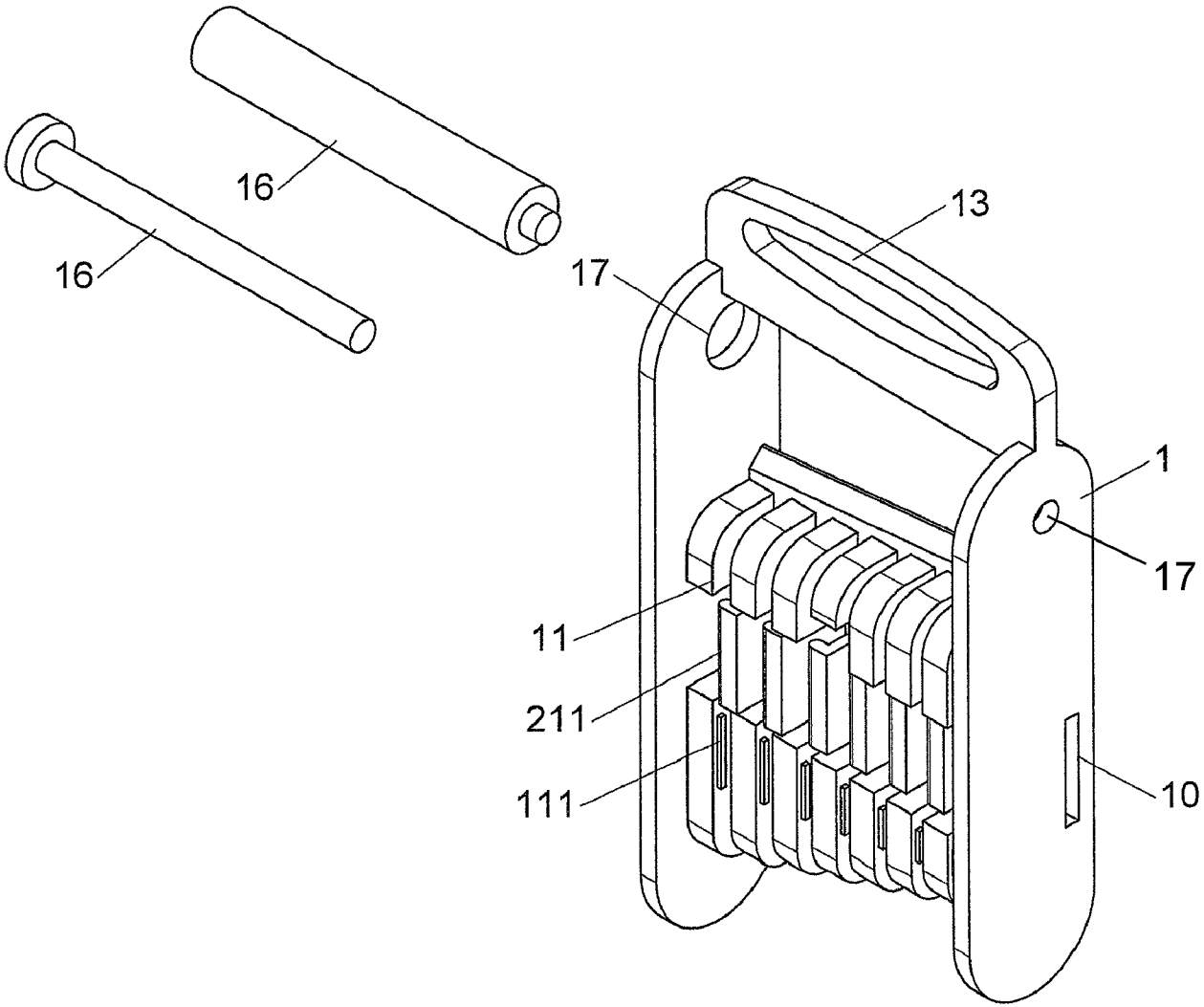
FIG. 12 shows two embodiments of the rod of the tool rack of the present invention.

As shown in FIG. 11, the frame 1 and the rod 16 two separate parts so that the rod 16 can be replaced with rods 16 of different shapes. As shown in FIG. 12, two connection holes 17 are defined through the two sidewalls of the frame 1, and two ends of the rod 16 extend through the two connection holes 17. The rod 16 can be a cylindrical rod with a circular cross section, a cylindrical protrusion extends from one end of the rod 16 so as to be engaged with the connection hole 17 or an enlarged head is formed on one end of the rod 16 so that the rod 16 does not drop from the other sidewall of the frame 1.

Figure 13:
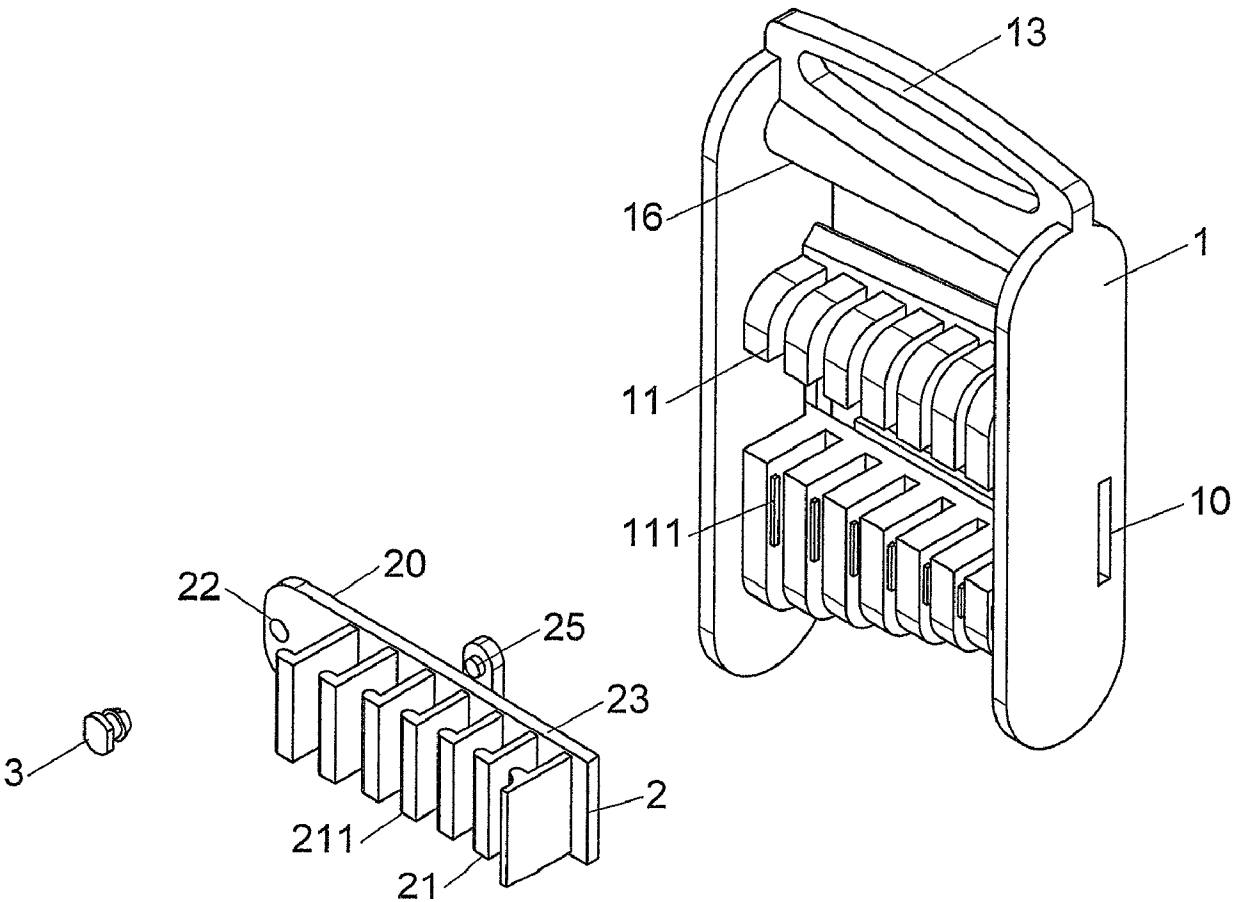
FIG. 13 is an exploded view to show a second embodiment of the tool rack of the present invention.
Figure 14:
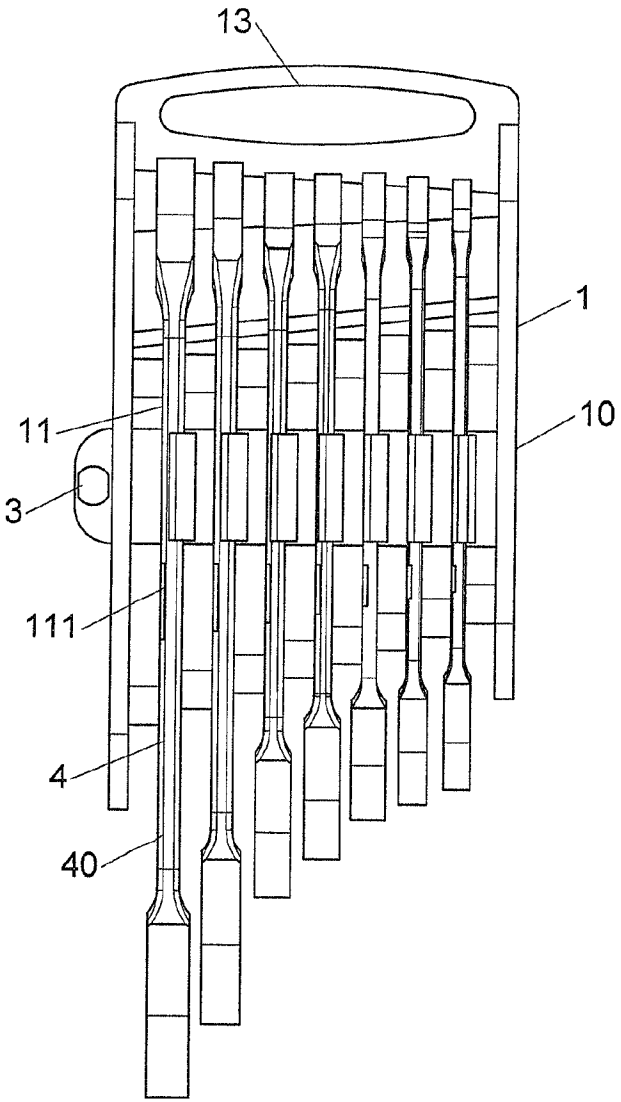
FIG. 14 is a front plane view of the tool rack in FIG. 13.

FIGS. 13 and 14 show that the restriction member 2 may have the through hole 22 located at an end of the restriction member 2 so that the through hole 22 is located beyond one of the two sidewalls of the frame 1. The locking pin 3 extends through the through hole 22 and contacts the outside of the sidewall of the frame 1.

Figure 15:
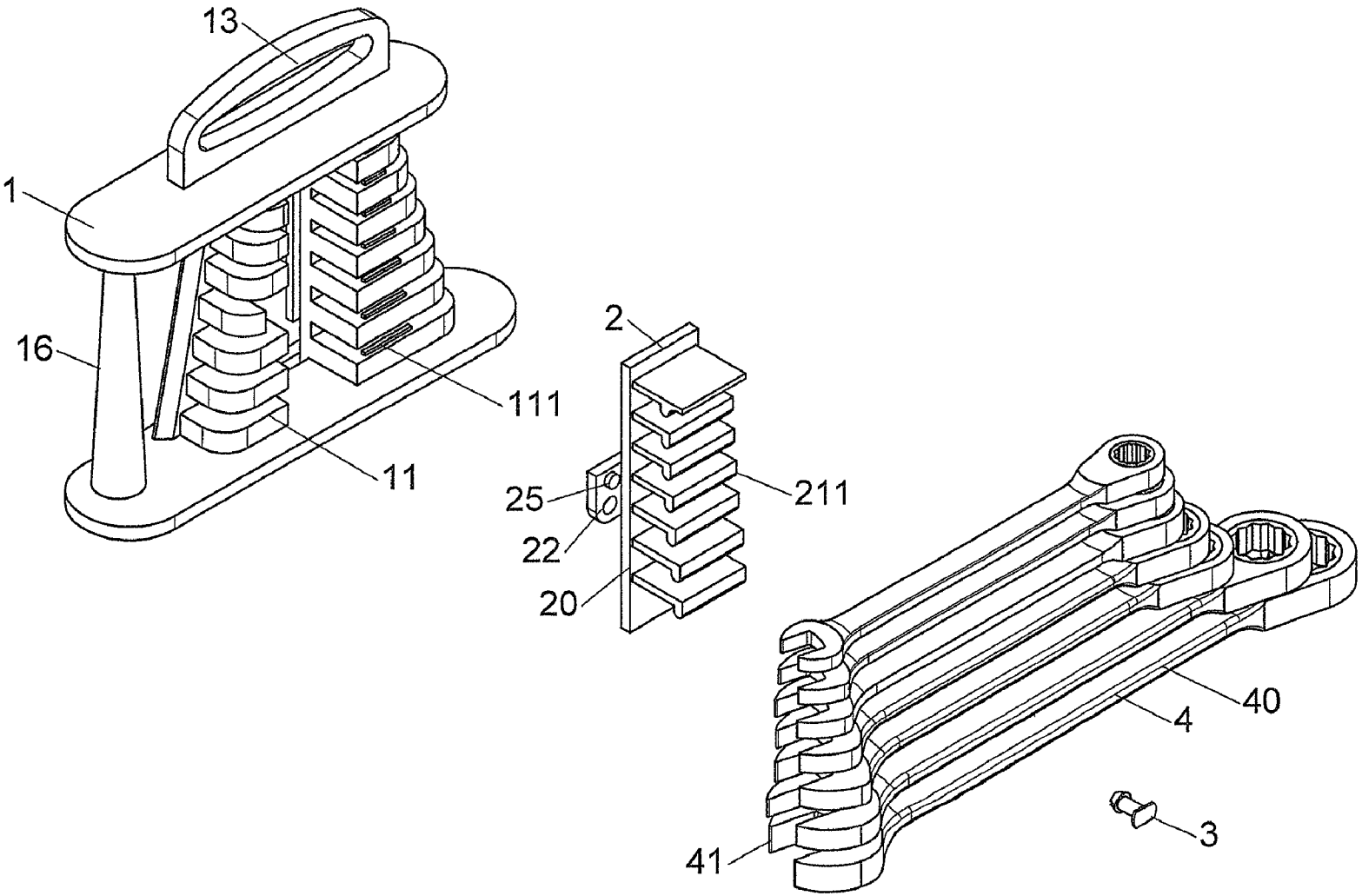
FIG. 15 shows that the handle hole is located at a side of the frame.
Figure 16:
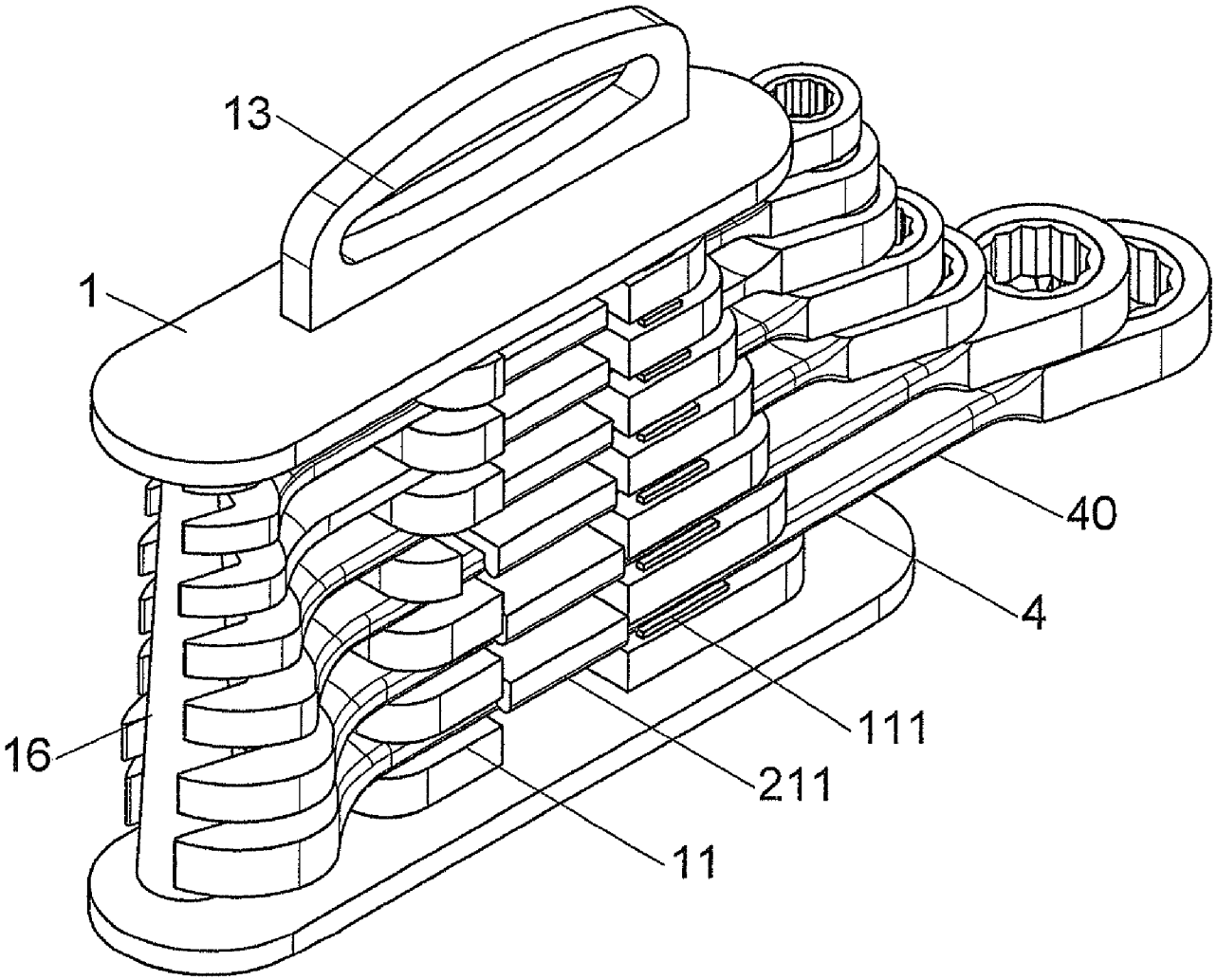
FIG. 16 is the perspective view of the tool rack in FIG. 15.
Figure 17:
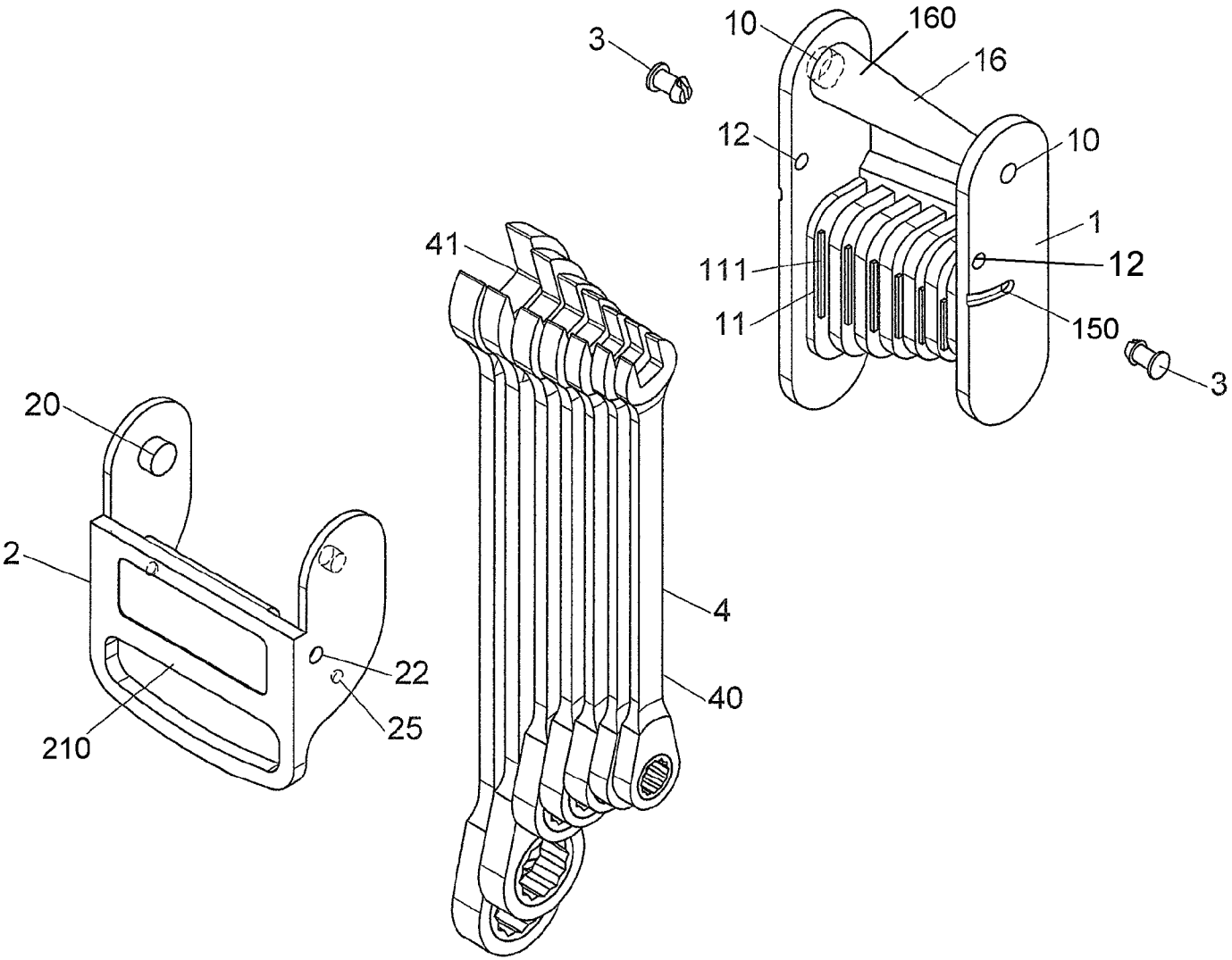
FIG. 17 is an exploded view to show a third embodiment of the tool rack of the present invention.

FIGS. 15 and 16 show that the handle is located on a side of the frame 1 so that when the user holds the handle, the tools 4 are located horizontally.

FIGS. 17 to 21 show another embodiment of the tool rack of the present invention, wherein the first connection portion 10 of the frame 1 includes two circular holes defined through two sidewalls of the frame 1. A plurality of first recesses 11 are defined in the frame 1 and a protrusion 111 extends from one of two insides of each first recess 11. A rod 16 is connected between the two sidewalls and shares a common axis with the first connection portion 10. The frame 1 includes two snap holes 12 in the two sidewalls thereof and two curved elongate slots 150 are defined in two outsides of the two sidewalls.

A restriction member 2 has a second connection portion 20 which is pivotably connected to the first connection 10 and the restriction member 2 is pivotable about an axis of the second connection portion 20. A restriction bar 210 is located to partially close the first recesses 11 when the restriction member 2 is not yet pivoted upward.

Figure 22:
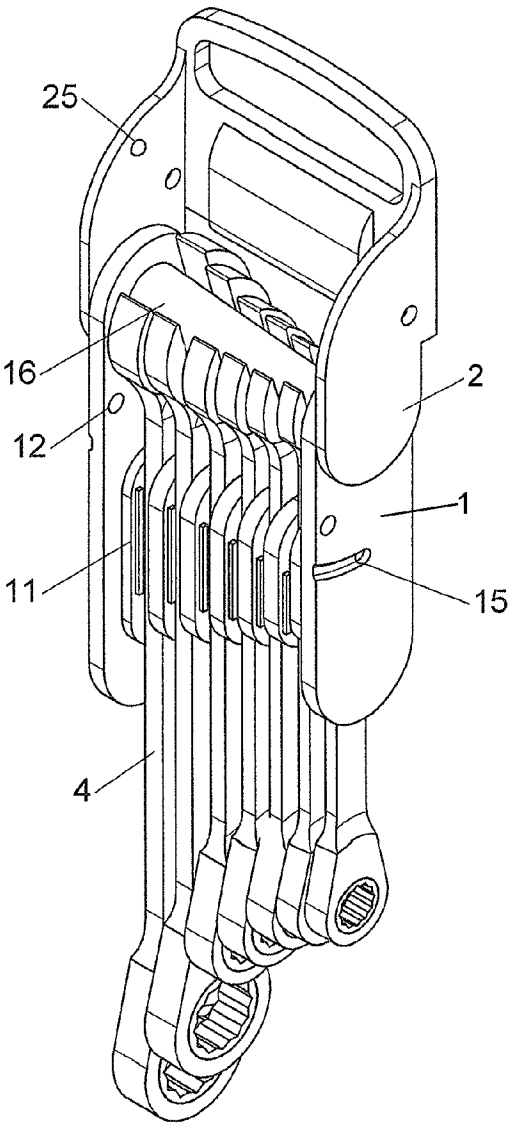
FIG. 22 is a perspective view to show the tool rack in FIG. 19, wherein the restriction member is pivoted upward.

The second connection portion 20 of the restriction member 2 is two cylindrical protrusions which are engaged with the two holes of the first connection portion 10. The restriction member 2 includes two through holes 22 on two sides thereof, the two locking pins 3 extend through the through holes 22 and engaged with the snap holes 12. The restriction member 2 further includes two positioning members 25 which are slidably engaged with the two curved elongate slots 150. The rod 16 can be a tapered rod. As shown in FIG. 22, when pivoting the restriction member 2 upward, the restriction bar 210 is removed from the first recesses 11 so that the tools 4 can be removed from the tool rack.

Figure 23:
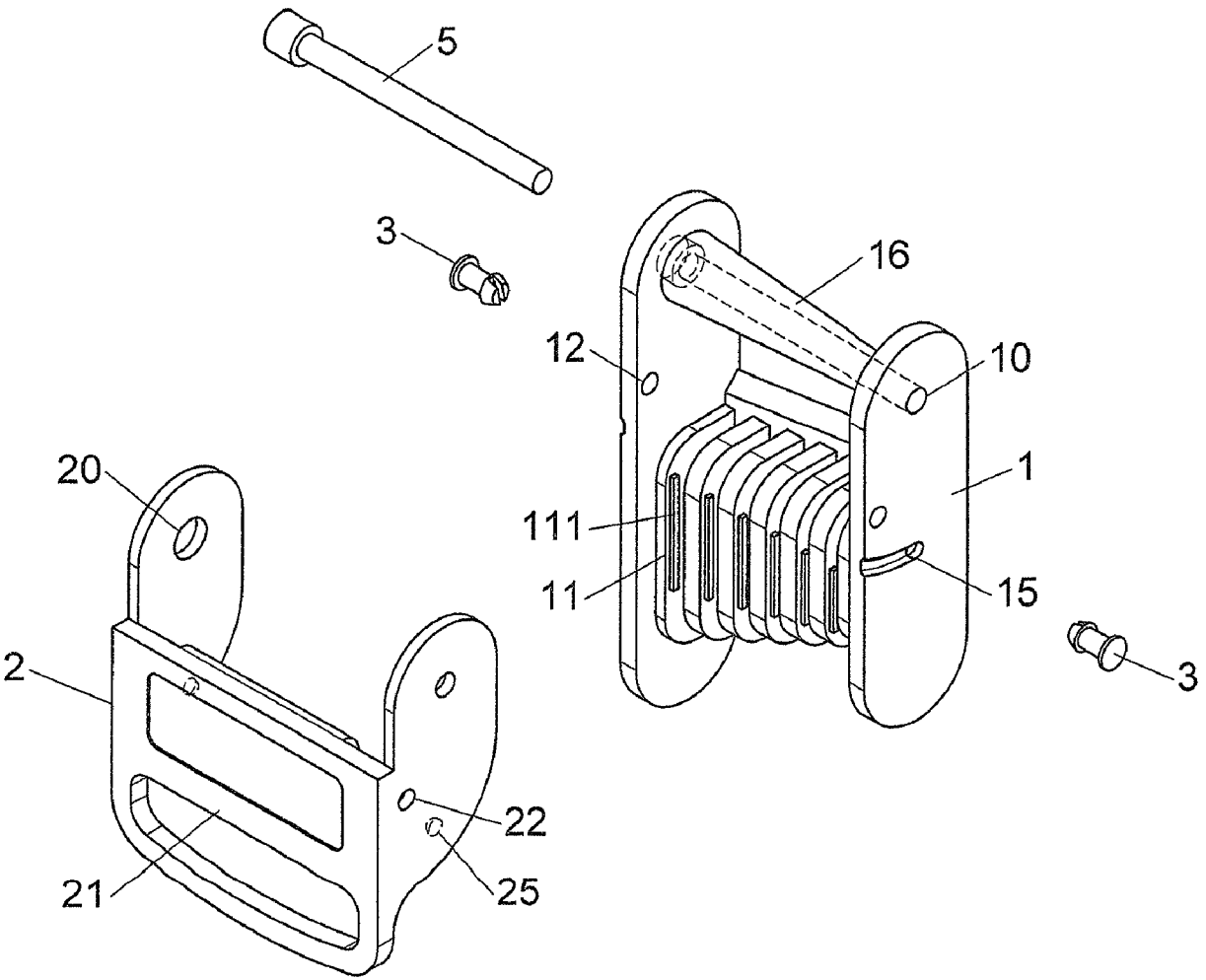
FIG. 23 shows that the restriction member in FIG. 19 is pivotably connected to the frame by a shaft.

FIG. 23 shows that the rod 16 may include an axial passage defined therethrough and the second connection portion 20 is two holes in two sides of the second restriction member 2. A shaft 5 extends through the first connection portion 10, the second connection portion 20 and the axial passage of the rod 16 to pivotably connect the frame 1 and the restriction member 2.

Figure 24:
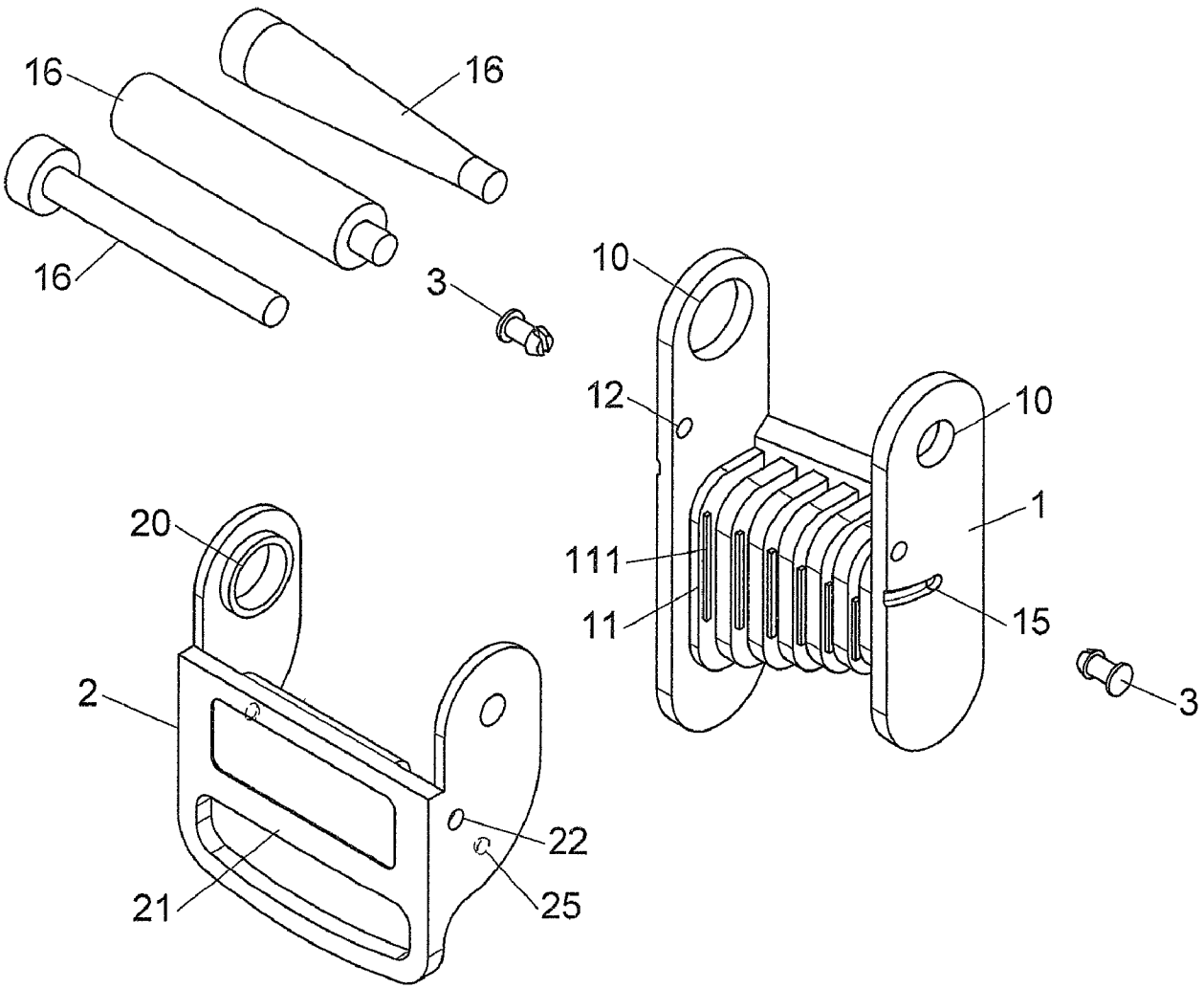
FIG. 24 shows different shapes of the rods used in the tool rack in FIG. 19.

FIG. 24 shows that the rod 16 and the frame 1 are two separate parts and the rod 16 can be replaced with the rods 16 with different shapes such as a cylindrical rod with a circular cross section.

Figure 25:
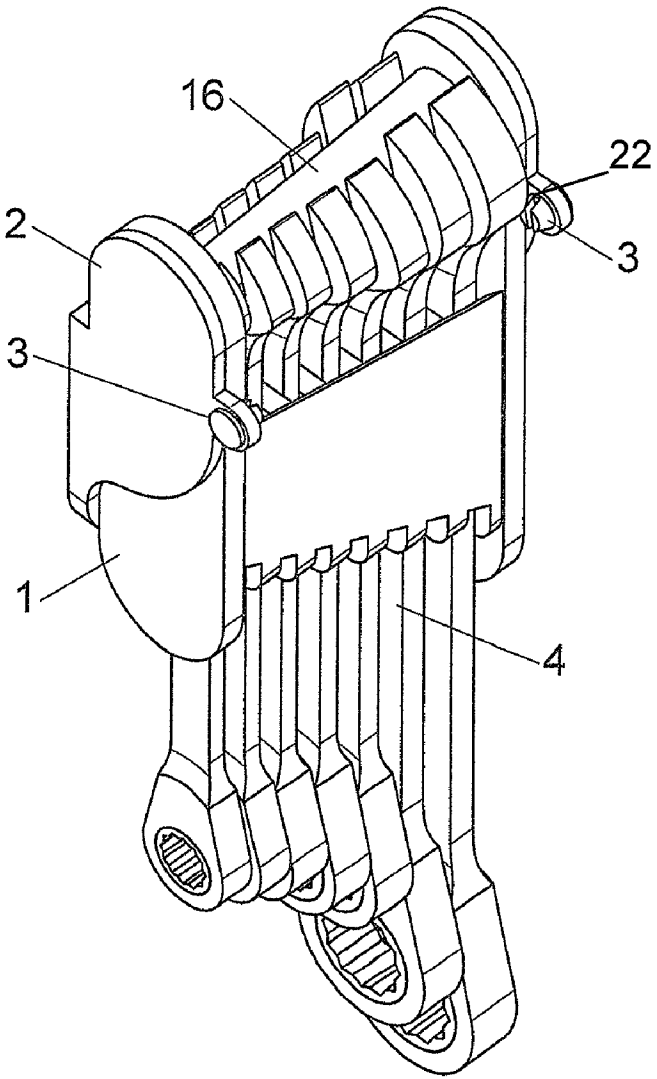
FIG. 25 shows that the through holes in the restriction member are located beyond the two rear sides of the sidewalls of the frames.

FIG. 25 shows that the restriction member 2 includes two through holes 22 defined in two sides thereof and located beyond the two sidewalls of the frame 1. The two locking pins 3 extend through the through holes 22 and contact two respective rear sides of the two sidewalls of the frame 1.

Figure 3:
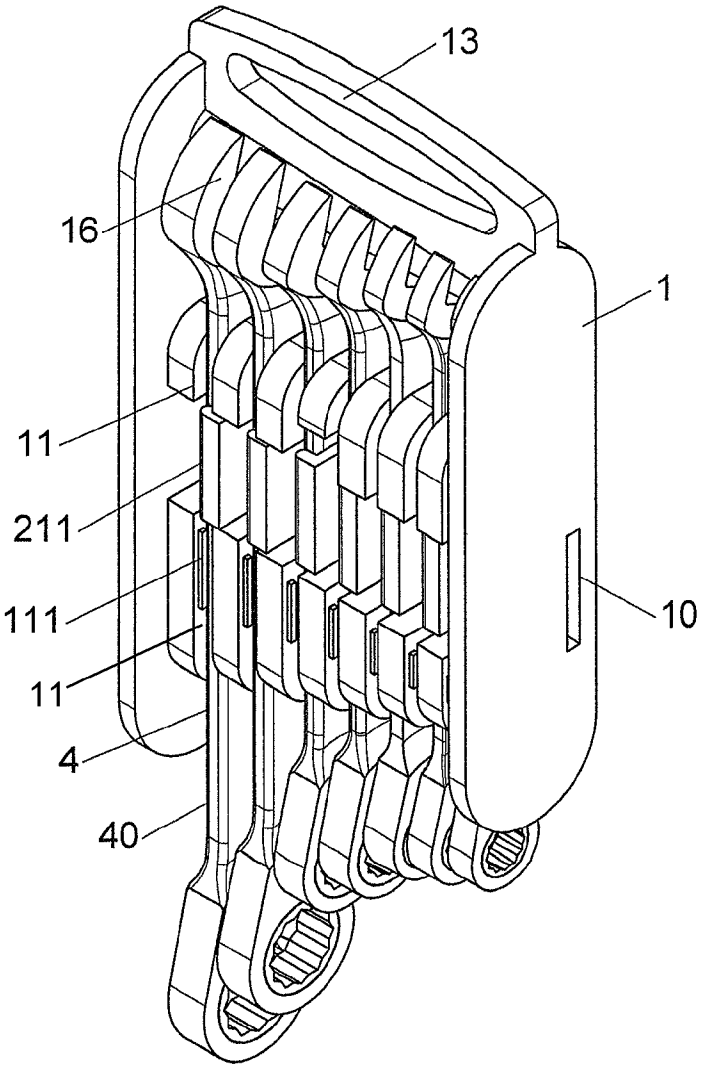
FIG. 3 is a perspective view to show the tool rack of the present invention and tools are received in the tool rack.
Figure 4:
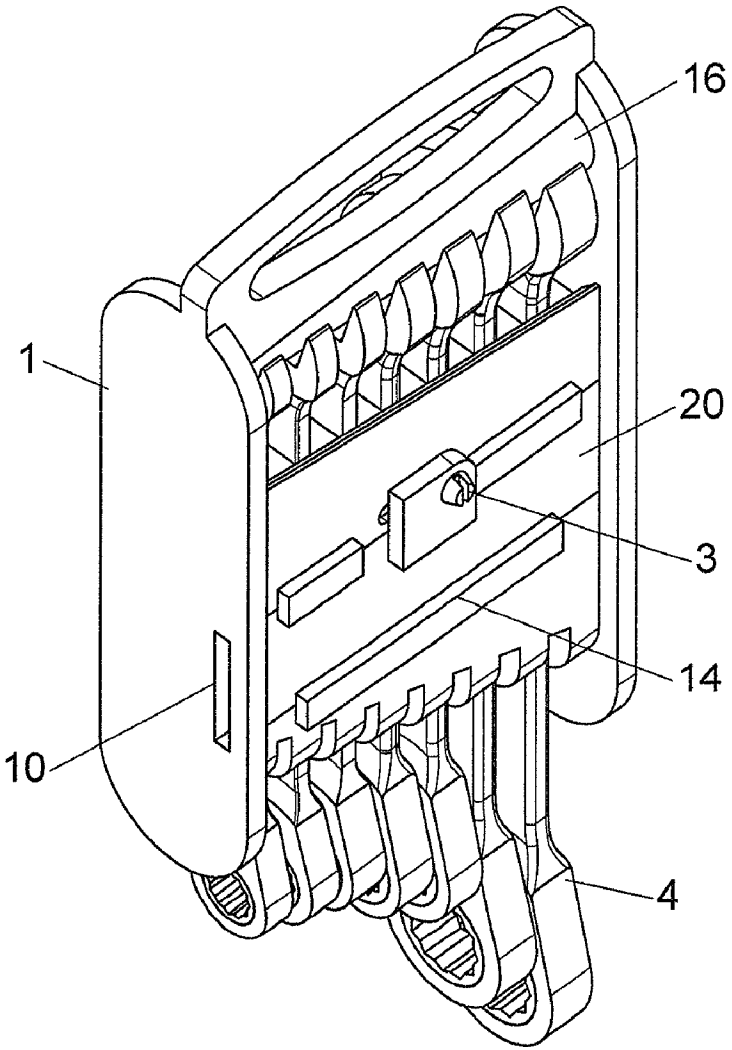
FIG. 4 is a perspective view, viewed from the rear side of the tool rack of the present invention.
Figure 18:
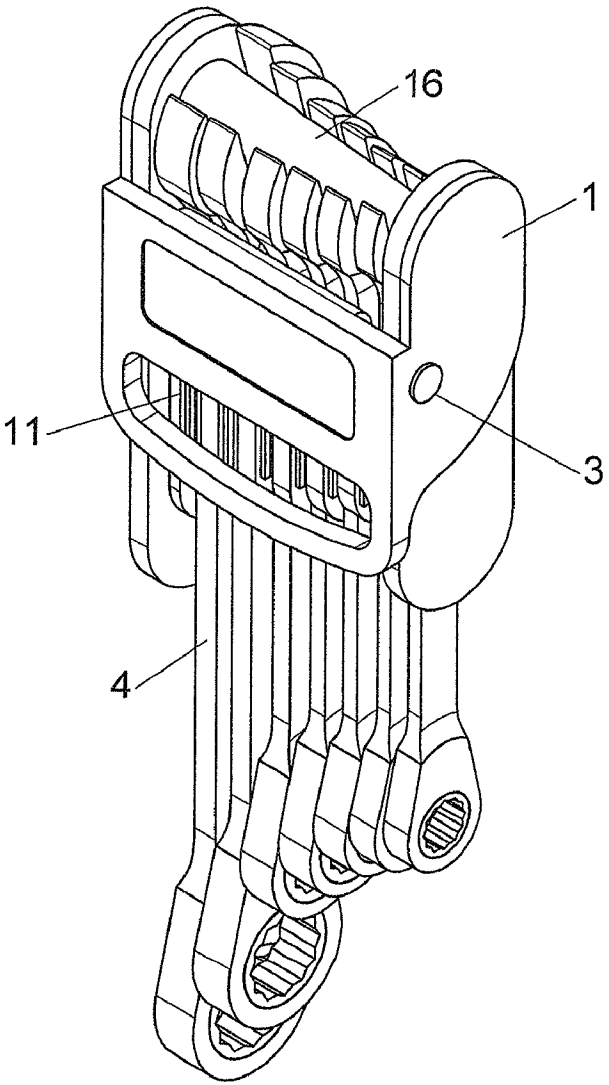
FIG. 18 is the perspective view of the tool rack in FIG. 17.
Figure 20:
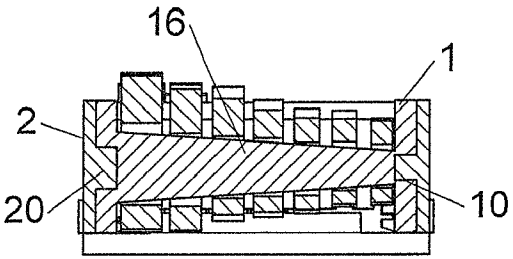
FIG. 20 is a cross sectional view, taken along line A-A in FIG. 19.
Figure 21:
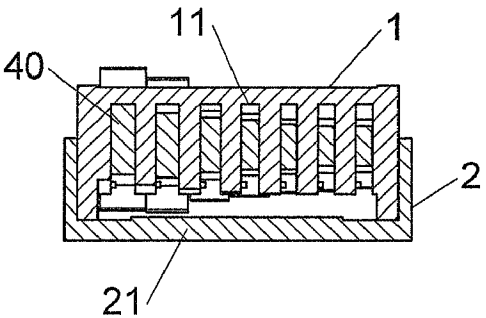
FIG. 21 is a cross sectional view, taken along line B-B in FIG. 19.
Figure 19:
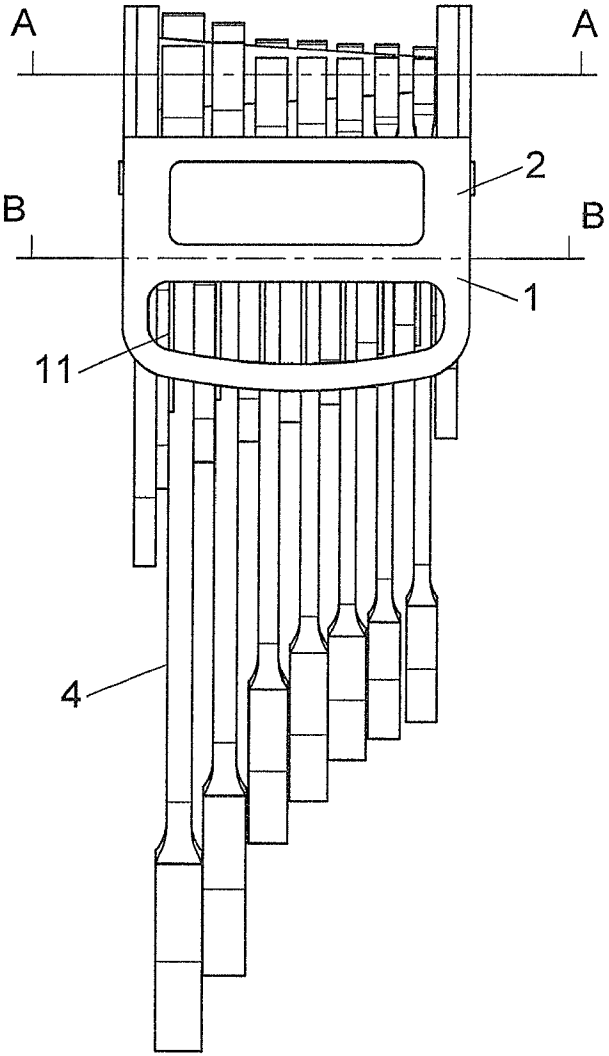
FIG. 19 is a front plane view of the tool rack in FIG. 17.

The tool rack as shown in FIGS. 3 and 4, the front side and the rear side of the tool rack are smooth and neat. The tool rack as shown in FIG. 18 has better aesthetic feature. The tools 4 are received in the tool rack in a way that saves space so that the tool rack can be compact and easily to carry. The tools 4 are well positioned in the tool rack and the function ends 41 are engaged with the second recesses 160 so that the function ends 41 are protected from being hit by foreign objects. The tapered rod 16 allows the tools 4 of different sizes to be organized in a neat way.

While we have shown and described the embodiment in accordance with the present invention, it should be clear to those skilled in the art that further embodiments may be made without departing from the scope of the present invention.

What is claimed is:

1. A tool rack comprising:

a frame having a first connection portion which includes two slots defined through two sidewalls of the frame, a plurality of first recesses defined in the frame each for engaging a shank of a tool and a protrusion extending from one of two insides of each first recess for holding the shank, a guide rail located between the two sidewalls and located close to the two slots of the first connection portion, a rod connected between the two sidewalls for engaging the function end of the tool;

a restriction member having a second connection portion which includes two distal ends which are movably engaged with the slots of the first connection portion, a plurality of third recesses defined in the restriction member and located in alignment with the first recesses, a stop plate extending from a distal end of an inside of each third recess, the stop plate movably located corresponding to the first recesses, the restriction member having a guide surface which is slidably engaged with the guide rail so that the restriction member is moved a distance to shift the stop plates relative to the first recesses, and a locking pin connecting the restriction member to the frame.

2. The tool rack as claimed in claim 1, wherein the first recesses are located on two sides of the restriction member.

3. The tool rack as claimed in claim 1, wherein the frame includes a snap hole and the restriction member has a through hole which is located in alignment with the snap hole, the locking pin extends through the through hole and snaps with the snap hole.

4. The tool rack as claimed in claim 1, wherein the frame includes a handle hole defined in a top portion thereof.

5. The tool rack as claimed in claim 3, wherein an elongate hole is defined in the frame and located close to the snap hole, the restriction member has a positioning member which is movably engaged with the elongate hole.

6. The tool rack as claimed in claim 1, wherein the rod is a tapered rod.

7. The tool rack as claimed in claim 1, wherein the stop plates are respectively located within the width of distal ends of the first recesses for holding the shank of the tool.

8. The tool rack as claimed in claim 1, wherein the rod and the frame are two separate parts and two connection holes are defined through the two sidewalls of the frame, two ends of the rod extend through the two connection holes.

9. The tool rack as claimed in claim 1, wherein the rod is a cylindrical rod with a circular cross section.

10. The tool rack as claimed in claim 1, wherein the restriction member includes a through hole which is located at an end of the restriction member and located beyond one of the two sidewalls of the frame.

* * * * *